US011378032B1

(12) United States Patent
Charbonnel

(10) Patent No.: US 11,378,032 B1
(45) Date of Patent: Jul. 5, 2022

(54) METHOD AND SYSTEM FOR MOVING HORIZON ESTIMATION FOR MACHINE CONTROL

(71) Applicant: Caterpillar Inc., Peoria, IL (US)

(72) Inventor: Sylvain J. Charbonnel, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/213,751

(22) Filed: Mar. 26, 2021

(51) Int. Cl.
*F02D 41/14* (2006.01)

(52) U.S. Cl.
CPC ..... *F02D 41/1406* (2013.01); *F02D 41/1445* (2013.01); *F02D 41/1446* (2013.01); *F02D 41/1448* (2013.01); *F02D 2041/1433* (2013.01); *F02D 2200/0406* (2013.01)

(58) Field of Classification Search
CPC ..... F02D 41/1406; F02D 41/1445; F02D 41/1448; F02D 41/1446; F02D 2200/0406; F02D 2041/1433
See application file for complete search history.

(56) References Cited

U.S. PATENT DOCUMENTS 6,401,457 B1 6/2002 Wang et al.
6,823,675 B2 * 11/2004 Brunell ..... F02C 9/00 60/773
7,904,282 B2 * 3/2011 Goebel ..... F02C 9/00 703/7
8,065,022 B2 * 11/2011 Minto ..... G05B 17/02 700/29
9,342,060 B2 * 5/2016 Fuller ..... G05B 13/048
10,423,473 B2 9/2019 Bengea et al.
2004/0102890 A1 * 5/2004 Brunell ..... G05B 13/048 701/100
2005/0193739 A1 * 9/2005 Brunell ..... G05B 13/042 60/772
2010/0256853 A1 * 10/2010 Rajamani ..... G05B 23/0235 702/34
2016/0365736 A1 * 12/2016 Block ..... G05B 13/0265
2016/0371585 A1 * 12/2016 McElhinney ..... G05B 23/0254
2017/0175645 A1 * 6/2017 Devarakonda ..... F01N 3/20
2018/0266347 A1 * 9/2018 Fuschetto ..... F02D 41/0087
2018/0300191 A1 * 10/2018 Bengea ..... G06F 11/0703
2020/0248622 A1 8/2020 Crowley et al.

* cited by examiner

*Primary Examiner* — Joseph J Dallo
(74) *Attorney, Agent, or Firm* — Bookoff McAndrews PLLC

(57) ABSTRACT

Systems and methods for controlling an engine are disclosed. A method for controlling an engine includes receiving a predetermined quantity of sensor values from a memory operatively connected to a sensor, each of the sensor values indicative of an operating condition of an inlet of a diesel particulate filter of the engine sensed by the sensor at a successive instance in time. A parameter of the operating condition of the inlet at a next instance of time may be estimated based on the predetermined quantity of sensor values. The estimation of the parameter may be used as a boundary condition to adjust an operational model of the engine stored in the memory. The adjusted operational model may be used to determine an engine command for the engine that optimizes operation of the engine. The engine may be operated based on the engine command determined using the adjusted operational model.

20 Claims, 6 Drawing Sheets

FIG. 2 – PRIOR ART

METHOD AND SYSTEM FOR MOVING HORIZON ESTIMATION FOR MACHINE CONTROL

TECHNICAL FIELD

The present disclosure relates generally to systems for internal combustion engine control, and more particularly, to methods and systems for moving horizon estimation for machine control, e.g., for an exhaust system of an internal combustion engine.

BACKGROUND

Internal combustion engines such as, for example, diesel engines, gasoline engines, and gaseous fuel powered engines, are supplied with a mixture of air and fuel for subsequent combustion within the engine that generates a mechanical power output. In order to maximize the power generated by this combustion process and reduce levels of resultant pollutants, the engine is often equipped with a turbocharged air induction system.

A turbocharged air induction system includes a turbocharger that uses exhaust from the engine to compress air flowing into the engine, thereby forcing more air into a combustion chamber of the engine than the engine could otherwise draw into the combustion chamber. This increased supply of air allows for increased fueling, resulting in an increased power output. A turbocharged engine typically produces more power than the same engine without turbocharging.

Control of the engine is often dependent on performance of the turbocharger. In particular, it is generally desirable for an optimized calibration of an engine, and in particular of the turbocharger, to lead to a feasible flow through the engine, e.g., a flow optimized based on modelled flow conditions at the compressor in which there is a balance between an intake mass flow rate into the engine and an exhaust mass flow rate fed into the turbine of the turbocharger. An inaccurate model of the performance of the turbocharger may lead to issues, e.g., a sub-optimal calibration and/or a calibration not reflective of the actual performance of the turbocharger. Additionally, it may be desirable to maintain such a feasible flow while also maintaining other operational parameters such as operating temperatures that provide for extended component life of the engine, exhaust gas products that are in compliance with emissions regulations, and etc. In order to maintain a feasible flow, it may be important to continuously monitor, estimate, or otherwise calculate operational characteristics of the engine, and in particular of the turbocharger, during operation of the engine. Generally, such operational characteristics are fed as inputs into an optimization model based on stored information about the engine, e.g., in the form of equations and/or variables modelling the behavior of the engine, that is used by the controller to determine commands for various engine systems and devices.

However, the stored information about the engine many not account for changing circumstances that diverge the operational behavior of the engine from the behavior model used to determine the commands. A conventional engine controller may thus be relying on an inaccurate understanding of the engine when attempting to determine commands for the various engine systems and devices. This type of mismatch between the modelled behavior of the machine and its actual behavior may result in inefficient optimizations, instabilities, risks, or even damage to the machine or its operator.

A fault-tolerant method for controlling a gas turbine engine is disclosed in U.S. Pat. No. 10,423,473. The method described in the '473 patent includes a step of determining updated parameters for a constrained model based control system for a gas turbine engine based on an identified fault condition associated with a reduced specification for an actuator or sensor below nominal. While the system described in the '473 patent may be useful in some circumstances, it may experience difficulties in the presence of circumstances that diverge the operational behavior of the engine from modelled behavior when such circumstances are not associated with a fault condition associated with an actuator or sensor.

The disclosed method and system may solve one or more of the problems set forth above and/or other problems in the art. The scope of the current disclosure, however, is defined by the attached claims, and not by the ability to solve any specific problem.

SUMMARY

In one aspect, an exemplary embodiment of a computer-implemented method for controlling a diesel engine includes receiving a predetermined quantity of sensor values from a memory operatively connected to a sensor, each of the sensor values indicative of an operating condition of an inlet of a diesel particulate filter of the diesel engine sensed by the sensor at a successive instance in time. A parameter of the operating condition of the inlet at a next instance of time may be estimated based on the predetermined quantity of sensor values. The estimation of the parameter may be used as a boundary condition to adjust an operational model of the diesel engine stored in the memory. The adjusted operational model may be used to determine an engine command for the diesel engine that optimizes operation of the diesel engine. The diesel engine may be operated based on the engine command determined using the adjusted operational model.

In another aspect, an exemplary embodiment of an engine control system for an engine may include a pressure sensor and an engine controller. The pressure sensor may be configured to sense an absolute pressure of an inlet of a diesel particulate filter of the engine. The engine controller may be operatively connected to the pressure sensor, and may include a memory and a processor operatively connected to the memory. The memory may store instructions for controlling the engine, and an operational model of the engine that includes a boundary condition associated with the absolute pressure of the inlet of the diesel particulate filter, the boundary condition initialized with a setpoint. The processor may be configured to execute the instructions to perform operations. The operations may include: at each instance in time, receiving a pressure value from the pressure sensor and storing the received pressure sensor value in the memory; in response to receiving and storing the pressure sensor value, determining whether a predetermined quantity of pressure sensor values are stored in the memory; in response to determining that the predetermined quantity of pressure sensor values are stored in the memory: estimating a parameter of the absolute pressure of the inlet of the diesel particulate filter at a next instance of time based on a most-recent predetermined quantity of the pressure sensor values; and using the estimation of the parameter as a boundary condition to adjust the boundary condition of the operational model associated with the absolute pressure of the inlet of the diesel particulate filter; using the operational model to determine an engine command for the engine; and operating the engine based on the engine command determined using the adjusted operational model.

In a further aspect, an exemplary embodiment for an engine system for a vehicle may include a diesel engine, a turbocharger, a pressure sensor, and an engine controller. The turbocharger may include a compressor and a turbine. The compressor may be operatively connected to an intake of the diesel engine. The turbine may be operatively connected to an exhaust of the diesel engine and to the compressor. The pressure sensor may be configured to sense an absolute pressure at an inlet of the turbine. The engine controller may include a memory and a processor. The memory may store an operational model of the engine and instructions for operating the engine. The processor may be operatively connected to the memory, and configured to execute the instructions to perform operations. The operations may include: receiving, from the pressure sensor, a predetermined quantity of pressure sensor values indicative of the absolute pressure at the inlet of the turbine at successive instances in time; estimating a parameter of the absolute pressure at an inlet of the turbine at a next instance of time based on the predetermined quantity of pressure sensor values; using the estimation of the parameter as a boundary condition to adjust the operational model of the engine stored in the memory; using the adjusted operational model to determine an engine command for the diesel engine; and operating the diesel engine based on the engine command determined using the adjusted operational model.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Figure 1:
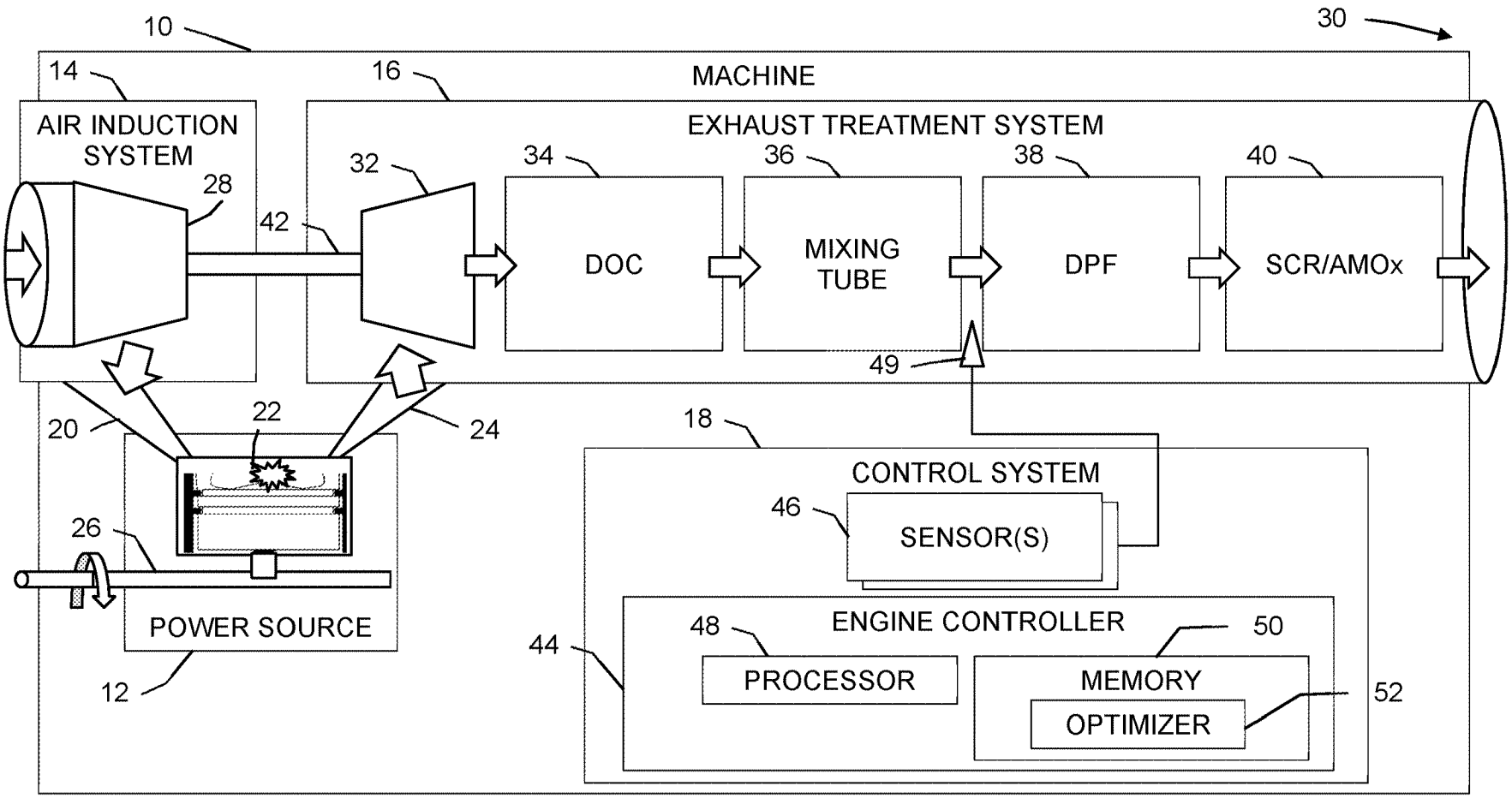
FIG. 1 is a partially schematic view of a machine including a power source controlled by an engine controller, according to aspects of the present disclosure.

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. The term "or" is used disjunctively, such that "at least one of A or B" includes, A, B, A and A, A and B, etc. Moreover, in this disclosure, relative terms, such as, for example, "about," "substantially," "generally," and "approximately" are used to indicate a possible variation of ±10% in the stated value.

In an exemplary illustrative use case, an engine system, e.g., for a vehicle, may include a diesel engine equipped with a turbocharger. The turbocharger may include a turbine powered by exhaust from the diesel engine, and a compressor powered by the turbine and operable to force air into an intake of the diesel engine. The engine system may further include an engine controller configured to optimize operation of the diesel engine, e.g., by maintaining a feasible flow through the diesel engine that balances a mass flow rate into the intake with a mass flow rate exhausted by the diesel engine and into the turbine. The engine controller may employ an optimizer that utilizes an operational model of the behavior of the diesel engine in order to determine engine commands that optimize the operation of the diesel engine.

The engine controller may be configured to adjust the operational model of the diesel engine in order to, for example, account for a divergence of the behavior of the diesel engine from the behavior modelled by the operational model. For instance, over time, ash, soot, ice, or the like may accumulate in a diesel particulate filter ("DPF") included in an exhaust system of the diesel engine, and result in a varying restriction of the exhaust system. This varying restriction may result in a change in the behavior of pressure at the inlet of the DPF. Pressure at the inlet of the DPF may be associated with a boundary condition of the operational model, and thus the engine controller may be configured to adjust the boundary condition, e.g., in order to account for the varying restriction due to the buildup of ash and/or soot over the course of operation.

At each instance in time during operation of the diesel engine, the engine controller may receive one or more sensor values from one or more sensors operatively engaged with one or more components of the engine system. For example, a pressure sensor may be configured to sense an absolute pressure value at the inlet of the DPF. A divergence between (i) an absolute pressure value at the inlet of the DPF at a particular instance of time and (ii) a prediction, based on the operational model, for the absolute pressure at the inlet of the DPF may be indicative of a divergence in behavior.

However, such indication may be insufficient to determine and/or account for a divergence of the diesel engine when determining optimal commands for operation of the diesel engine. For example, the optimization of the operation of the diesel engine by the engine controller may include making predictions for the absolute pressure value at the inlet of the DPF at a future instance of time. For instance, the engine controller may be applying hypothetical scenarios for the future instance of time in order to find an optimum calibration for the engine. At that future instance in time, various operating conditions of the diesel engine that may affect pressure may be different than at the instance in time at which the pressure was last measured. For example, the engine controller may be configured to determine an optimal command to increase an output torque of the diesel engine, which may result in a change to a fuel mass flow rate, an engine timing, or other factors, which may result in a change to conditions that may affect the pressure at the inlet of the DPF. As a result, a direct comparison between a pressure reading at an instance of time and a prediction of the pressure at the same instance may not be sufficient to predict a behavior of the pressure at a future instance of time.

Thus, it may be beneficial for an engine controller to employ a technique that enables the prediction of an operating condition of the diesel engine at future instances based on a divergence in a previous instance of time. The engine controller may include a parameterized model of one or more operating conditions of the diesel engine, and may use the parameterized model as a replacement for the boundary condition of the operating condition in the operational model. For example, the pressure at the inlet of the DPF may be parameterized by one or more parameters. Based on experimentation, parameterization of the pressure at the inlet may correlate, at least in part, to a parameterization using two parameters. For example, the parameterization may include a first parameter that may be adjusted on-line in the parameterized model to account for changes in the behavior of the pressure (e.g., due to a varying restriction in the DPF), and a second parameter that may be predetermined in an off-line manner.

The engine controller may use a pressure value from the absolute pressure sensor to, for example, determine a value for the first parameter, and then adjust the boundary condition of the operational model using the determined first parameter value. In some instances, this determination may benefit from a technique that reduces noise that may be present in the pressure sensor values recorded by the pressure sensor. In some instances, this determination may benefit from a technique that accounts for previous changes to the first parameter. For example, in some instances, the determination of the value of the first parameter may include a moving horizon estimation based on previous pressure sensor values from the pressure sensor and previous pressure predictions. Further details of these and other techniques are provided below.

FIG. 1 illustrates an exemplary machine 10 having multiple systems and components that may operatively cooperate to accomplish a task. The machine 10 may perform various operations associated with an industry such as mining, construction, farming, transportation, power generation, or any other suitable industry. For example, the machine 10 may be a mobile machine such as an on-highway vocational vehicle, an off-highway haul truck, an excavator, a dozer, a loader, a motor grader, or any other industrial moving machine. The machine 10 may alternatively be a stationary machine such as a generator set, a furnace, or another suitable stationary machine. The machine 10 may include a power source 12, an air induction system 14, an exhaust treatment system 16, and a control system 18.

The power source 12 may include a combustion engine having multiple subsystems that operatively interact to produce mechanical power output. The power source 12 may include, for example, an inlet 20 for receiving fuel and/or air, a combustion chamber 22 for combusting a mixture of fuel and air, an outlet 24 for exhausting a flow of exhaust gas, and a power output member 26 for outputting the mechanical power resulting from the combustion. In this embodiment, the power source 12 is a diesel engine. However, it should be understood that the power source 12 may be any other suitable type of combustion engine such as, for example, a gasoline or a gaseous fuel-powered engine, or combinations thereof. The multiple subsystems included in the power source 12 may include, for example, a fuel system, a lubrication system, a cooling system, a drive system, a guidance system, or any other appropriate system (not shown).

The air induction system 14 may include one or more components that condition and introduce compressed air into the combustion chamber 22 of the power source 12. For example, the air induction system 14 may include a compressor 28. In various embodiments, the air induction system 14 may include different and/or additional components than described above such as, for example, an air filter, an air cooler, inlet bypass components, and other known components (not shown).

The compressor 28 may be configured to compress the air flowing into the inlet 20 of the power source 12. The compressor 28 may have a fixed geometry type, a variable geometry type, or any other suitable geometry type. In some embodiments, a plurality of compressors may be arranged in series and/or in parallel within the air induction system 14.

The exhaust treatment system 16 may be configured to treat and direct the flow of the exhaust gases from the outlet 24 of the power source 12 to an atmosphere 30. For example, the exhaust treatment system 16 may include a turbine 32 and one or more treatment or direction components such as, for example, a Diesel Oxidation Catalyst ("DOC") 34, a mixing tube 36, a Diesel Particulate Filter ("DPF") 38, and a Selective Catalyst Reduction element with an Ammonia Oxidation Catalyst ("SCR/AMOx") 40. It should be understood that the aforementioned components of the exhaust treatment system 16 are exemplary only, and that additional and/or different components may be included in various embodiments.

The turbine 32 may be operatively connected to the power source 12 to receive the exhaust gasses flowing from the outlet 24 of the power source 12, and may be configured to drive the compressor 28. For example, as the exhaust gases exhausted from the power source 12 expand against blades (not shown) of the turbine 32, the turbine 32 may rotate a common shaft 42 to drive compressor 28. In various embodiments, a plurality of turbines may be included in parallel or in series within the exhaust treatment system 16.

The control system 18 may include one or more components that cooperate to monitor the operation of air induction system 14, exhaust treatment system 16, and the power source 12. In particular, the control system 18 may be configured to sense one or more operating conditions of the machine 10, and, in response to the sensed operating conditions, perform one or more estimations, calculations, modellings, or the like for control of the machine 10. The control system 18 may include, for example, an engine controller 44 and one or more sensors 46.

The engine controller 44 may be operatively connected to the one or more sensors 46 and/or other components of the machine 10. The engine controller 44 may include one or more processors 48 and one or more memory 50. Various other suitable components, e.g., power supply circuitry, signal conditioning or processing circuitry, or the like, may also be included in the engine controller 44 in various embodiments. Although depicted as a single element in FIG. 1, it should be understood that the engine controller 44, in some embodiments, may be distributed over a plurality of elements in any suitable arrangement.

The one or more sensors 46 may include, for example, one or more pressure sensors, e.g., pressure sensor 49 disposed at an inlet of the DPF 38. Other pressure sensors that may be included are, for example, an ambient pressure sensor of the atmosphere 30, a pressure sensor at the inlet 20, at the outlet 24, or the like (not shown). The one or more sensors 46 may include one or more temperature sensors, e.g., to sense an ambient temperature, a temperature of the exhaust gas, or the like. The one or more sensors 46 may include one or more position or speed sensor, e.g., to sense a position and/or speed of one or more components of the machine 10 and/or of the machine 10 itself. Any suitable type of sensor, and any suitable arrangement of the one or more sensors 46, may be used. Generally, a sensor may be configured to generate a signal indicative of a value associated with an operating condition of the machine 10, e.g., that may be received and interpreted by the engine controller 44 and/or other components of the machine 10.

The memory 50 of the engine controller 44 may store data and/or software, e.g., instructions, models, algorithms, equations, data tables, or the like, that are usable and/or executable by the processor 48 to perform one or more operations for controlling the machine 10. For example, engine controller 44 may be configured to receive input, e.g., from an operator of the machine 10 and/or any other suitable source, and generate engine commands based on the input. The engine controller 44 may be configured to generate the engine commands based on one or more operating conditions of the machine 10, e.g., as indicated by the one or more sensors 46. For example, the memory 50 may include an optimizer 52 that, when executed by the processor 48, is configured to generate engine commands that optimize the operation of the machine 10.

As used herein, optimizing the operation of the machine may generally encompass, for example, generating an engine command that not only is usable to operate the machine 10, e.g., in response to input from an operator, but also one or more of minimizing a fuel consumption, noise production, etc., maximizing a power output, maintaining operation of one or more components of the machine 10 within predetermined limits, or the like. In particular, the optimizer 52 may be configured to optimize operation of the machine 10 by maintaining a feasible flow through the power source 12 and exhaust treatment system 16, e.g., a flow whereby a first mass flow rate through the compressor 28 is at least substantially balanced with a mass flow rate through the turbine 32. Controls available to the engine controller 44 for balancing the mass flow rates may include, for example, the speed of one or more of the compressor 28 or turbine 32, the air/fuel mixture entering the power source 12, an engine timing of the power source 12, or any other suitable actuator or control element.

The total effective mass flow rate ("TMEF"), e.g., through an element such as the compressor 28 or turbine 32, may be expressed in terms of flow velocity (u) by:

$$u = \frac{TMEF}{\rho A} \quad \text{Eq. (1)}$$

where "A" is the cross-sectional area of the element, and "ρ" is the density of the fluid passing there through e.g., air and/or fuel. The cross-sectional area "A" is based on the physical configuration of the element, and may be determined off-line. In some embodiments, the "TMEF" may be calculated via equation 1, and the flow velocity "u" may be determined, for example, based on one or more of a speed of the turbine 32, one or more of the sensors 46, or the like. In some embodiments, the "TMEF" may be sensed, and the flow velocity may be calculated via equation 1. In some embodiments, the "TMEF" may be sensed or modelled based on one or more of a pressure at an intake manifold of the engine, engine speed, a modeled volumetric efficiency, fuel flow, or other factors. Density of the fluid, e.g., at the inlet of the DPF 38, may be expressed in terms of temperature and pressure by:

$$\rho = \frac{P_{baro}}{RT_{dpf}} \quad \text{Eq. (2)}$$

where "$P_{baro}$" is the ambient pressure of the atmosphere 30, "R" is a constant associated with the air/fuel mixture forming the exhausted gasses, and "$T_{dpf}$" is a temperature at the inlet of the DPF 38. The temperature and pressure may be determined, for example, via one or more of the sensors 46.

As noted above however, while operating conditions such as those mentioned above, and in particular the pressure at the inlet of the DPF 38, may be measured on-line during operation of the engine, optimizing the control of the machine 10, e.g., via the optimizer 52, may include making predictions about the behavior of various components of the machine 10 and/or evaluating hypothetical scenarios for the power source 12 at a future instance in time in which circumstances affecting one or more operating conditions may differ from circumstances at the time at which measurements were taken.

Thus, when making predictions, the engine controller 44 may estimate a value for an operating condition, such as the pressure at the inlet of the DPF 38, based on one or more other operating conditions and/or a model of the behavior of the machine 10 and/or of the operating condition itself.

In a conventional machine, the behavior of a component that may vary over time or in the present of different conditions, such as a DPF, may be modelled as a setpoint corresponding to an average or midline performance of the component. For instance, the pressure at an inlet of a DPF in a conventional machine may be modelled based on a predetermined setpoint of a parameter, the flow velocity "u", and a flow viscocity "μ", which may be predetermined and/or modelled, e.g., based on a detected temperature. In another example, the setpoint of a component may be adjusted based on a predetermined model, e.g., a degradation rate or curve. While the foregoing examples may allow estimations of an operating condition such as the pressure at the inlet of the DPF to be made for the conventional machine, such predetermined setpoints or setpoint curves may not accurately account for the rate, manner, and/or magnitude of the variance of the behavior of the an operating condition such as the pressure at the inlet of the DPF. In other words, modeling an operating condition such as pressure at the inlet of the DPF may be insufficient to efficiently and/or accurately predict and/or model that actual behavior of the machine, e.g., exhaust restriction in an exhaust system of an engine in hypothetical scenarios, which may result in an inaccurate modelling of the air flow through the engine and/or an inaccurate flow feasibility evaluation.

Figure 2:
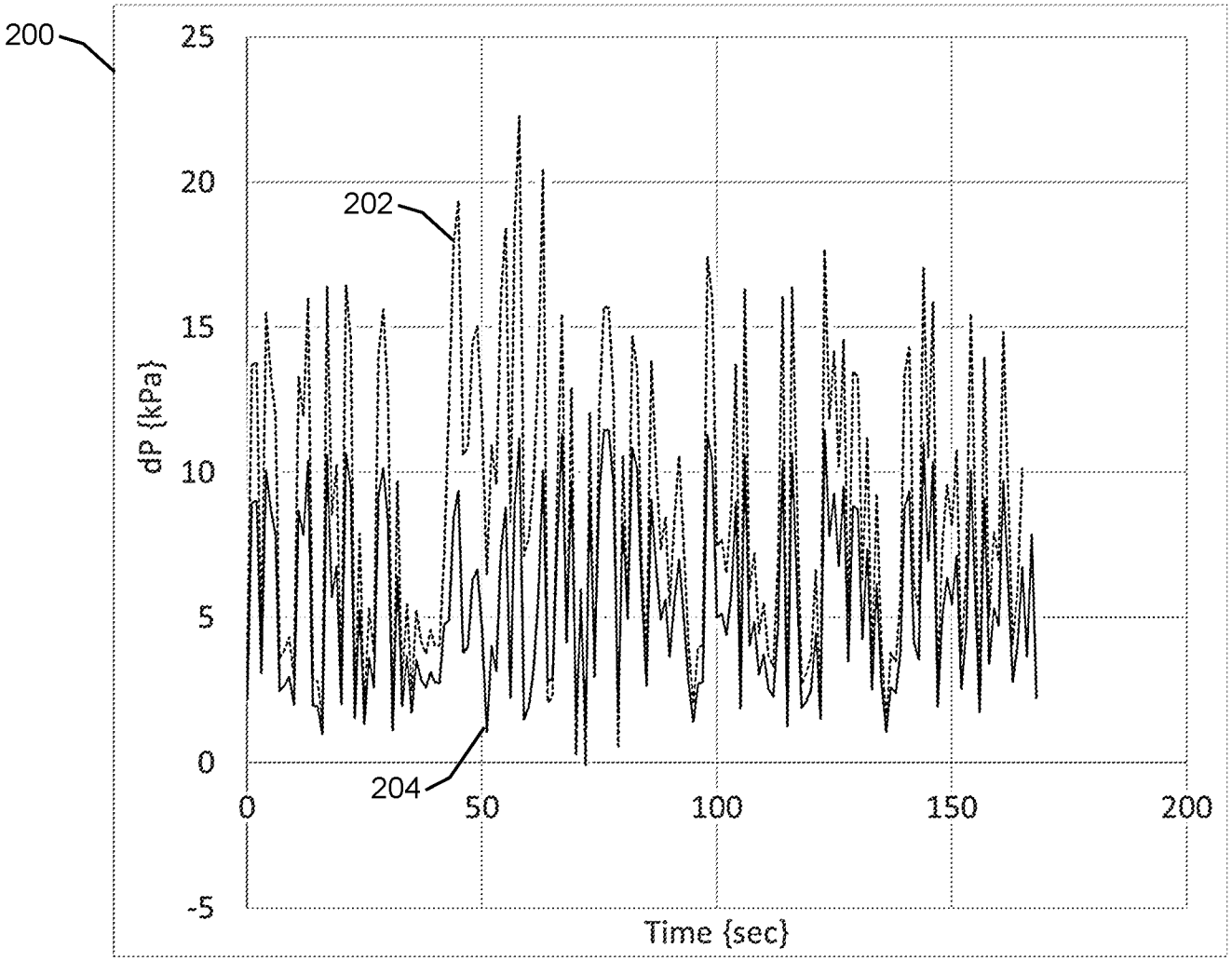
FIG. 2 (Prior Art) is a chart illustrating how the behavior of pressure in an engine system may diverge from modeled behavior in response to a disturbance.

For example, FIG. 2 (Prior Art) depicts a chart 200 illustrating divergence between simulated behavior 202 of pressure at the inlet of a DPF in a machine (dashed line) and predictions 204 for the pressure at the inlet of the DPF (solid line) made using a conventional model of the machine, with time in seconds along the horizontal axis, and pressure above ambient along the vertical axis. To illustrate how a divergence between the modelled behavior 204 and simulated actual behaviors 202 may arise, a disturbance to the simulated actual pressure 202 at the inlet of the DPF was introduced, with a +5 kPa change from about 45 seconds to about 60 seconds, and a −2 kPa change from about 60 seconds to about 90 seconds. As shown in the chart of FIG. 2, during the disturbance (e.g., from about 45 seconds to about 90 seconds), the modelled behavior 204 diverges from the simulated actual behavior 202 by an average of about 20 kPa. And, even after the disturbance concludes, a divergence of about 10 to 15 kPa persists.

As a result of this type of divergence between modelled and actual pressure, the behavior of a power source in a conventional machine may diverge from the behavior modelled by a conventional engine controller. Such divergence may result in a conventional optimizer having difficulty generating optimal commands for the power source. Flow feasibility between the mass flow rates at the inlet and outlet may deteriorate, a rate of fuel consumption by the power source may spike, and/or the efficiency or operability of the machine may decrease.

Thus, in order to generate an estimate for an operating condition in the machine 10, e.g., the pressure at the inlet of the DPF 38, the engine controller 44 may be configured to utilize a model and/or parameterization of the operating condition that is dynamically adjustable.

While any suitable parameterization of pressure may be used, in some embodiments, the pressure at the inlet of the DPF 38 may be parameterized by:

$$\Delta P = f(\rho, c_1, c_2, \mu, u) \quad \text{Eq. (3)}$$

whereby "ΔP" is the difference between the pressure at the inlet of the DPF 38 and the ambient pressure of the atmosphere 30, the density "ρ" is given by Equation 2 above, and "μ" is the flow viscosity.

In the parameterization above, it has been determined, via experimentation, that the "$c_1$" parameter may be associated with, and/or may vary in a manner at least partially correlated with a static configuration of the machine 10 and/or the DPF 38. Further, the "$c_2$" parameter may be associated with, and/or may vary in a manner at least partially correlated with the dynamic operating behavior of the DPF 38. In particular, it has been determined that adjustment to the "$c_2$" parameter may, at least to some extent, account for variance in the behavior of pressure at the inlet of the DPF 38 due to, for example, accumulation of ash or soot, ice, or the like, over the course of operation of the machine 10.

A comparison between a model prediction of the pressure at an instance of time "ΔP" with an actual measurement of the pressure at the same instance of time "$\Delta P_{meas}$", along with the value of the "$c_2$" parameter at the same instance of time, may be used to determine a new value for the parameter, "$c_{2(new)}$" that would adjust the parameterized model of the pressure to account for the current behavior of the DPF 38, e.g., by:

$$0 = W_1(\Delta P - \Delta P_{meas})^2 + W_2(c_{2(new)} - c_2)^2 \quad \text{Eq. (4)}$$

whereby the modelled pressure "ΔP" is given by equation 3 above. The term "$W_1$" is an off-line tunable weight associated with an accuracy of the parameterization, e.g., how closely the modeled behavior is desired to track the actual behavior. The term "$W_2$" is an off-line tunable weight associated with the rate at which the "$c_2$" parameter may be adjusted at each instance of time.

However, in some instances, the pressure at inlet of the DPF 38 may be susceptible to a variety of changing conditions in the machine 10, and thus the value of the pressure may be noisy, e.g., may vary in a manner that may not be correlated with or indicative of the behavior of the DPF 38. Further, significant changes to the parameterization of the pressure may impact the operation of the optimizer 52. For example, a high rate of change in the modelled behavior of the pressure may make it difficult for the optimizer 52 to achieve stable operation of the machine 10. Thus, it may be beneficial for the engine controller 44 to utilize a technique for adjusting the behavior model of the machine 10 that reduces the noisiness of an operating condition such as the pressure at the inlet of the DPF 38. Further, it may be beneficial for the engine controller 44 to utilize a technique for adjusting the behavior model of the machine 10 that facilitates stable operation of the machine 10, e.g., by inhibiting adjustments to the behavior model from impacting the operation of the machine 10.

In some embodiments, the engine controller 44 may be configured to adjust the parameterization and/or model of an operating condition, such as the pressure at the inlet of the DPF 38, via a moving horizon estimation. Instead of determining a new value for a parameter based on a comparison of a model prediction of an operating condition and a measurement of the operating condition, such as in the manner discussed above, a moving horizon estimation may apply a cost minimization function to a set of successive instances in time. In other words, by accounting for multiple instances of time when determining an adjustment to the operational model of the machine 10, the engine controller 44 may reduce the noisiness of the changes to the operational model and promote a stable operation of the machine 10. Expanding on equation 4 above, a cost minimization function for a moving horizon estimation of the pressure at the inlet of the DPF 38 may be expressed by:

$$\min_{c_2} J = \sum_{k-N}^{k} W_1(\Delta P - \Delta P_{meas})^2 + W_2 \Delta c_2^2 \quad \text{Eq. (5)}$$

whereby "$\Delta c_2$" is an expression of the change in the "$c_2$" parameter, e.g., "$(c_{2(new)} - c_2)$", "k" is an index for an instance of time among "N" total instances in the set used to make the estimation, e.g., the "size" of the horizon. Thus, equation 5 may be used to estimate a new $c_2$" parameter for each successive instance in time, e.g., based on the N-most recent preceding instances in time.

Any suitable values may be used for the weights "$W_1$" and "$W_2$". A relatively higher value for a ratio of "$W_2$" to "$W_1$" may result in an adjusted model that is relatively more responsive to changes in the behavior of the pressure at the inlet of the DPF 38, e.g., that may more accurately track a change, but that may be more susceptible to noise. Any suitable number of instances "N" may be used for the moving horizon estimation. As an illustrative example, for instances in time encompassing about 1-5 seconds, a number of instances "N" that cumulatively account for about 30 seconds, 60 seconds, or 120 seconds may be used.

It should be understood that for instances in time to be "successive" does not require that such instances are immediately successive. For example, at some instances of time, the actual measurement of the pressure at the same instance of time "$\Delta P_{meas}$" may not have been recorded and/or stored. For example, the measurement may have failed a data quality evaluation. A previous measurement that satisfied the quality evaluation and a subsequent measurement that also satisfies the quality evaluation may be considered successive, despite the intervening measurement that failed the quality evaluation and/or was not measured or stored. In an example, for an N of five, measurements at instances one to four may be stored in a memory, no measurement may be stored at instance five, and a further measurement may be stored at instance six. The instances one, two, three, four, and six may be considered successive when performing the moving horizon estimation.

Figure 3:
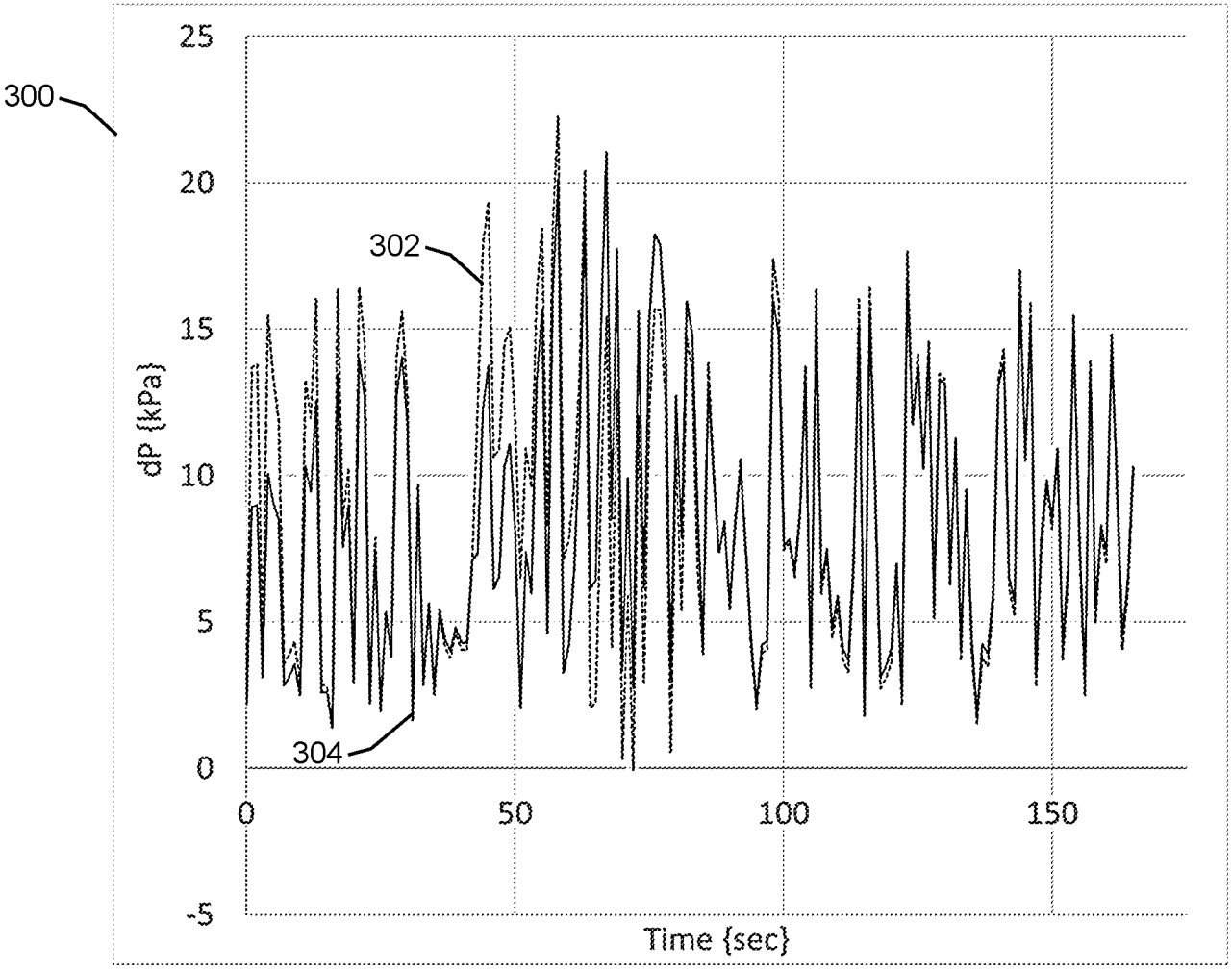
FIG. 3 is a chart illustrating how the adjustment of an operational model using moving horizon estimation may improve the alignment of the operational model with the behavior of the engine system.

FIG. 3 depicts a chart 300 illustrating a comparison between simulated behavior 302 of pressure at the inlet of a DPF 38 in the machine 10 (dashed line) and predictions 304 for the pressure at the inlet of the DPF 38 (solid line) made using a behavioral model of the machine 10 that is continually adjusted using moving horizon estimation in a manner similar to the techniques discussed above, with time in seconds along the horizontal axis, and pressure above ambient along the vertical axis. The same disturbance to the pressure as discussed with regard to FIG. 2, e.g., a +5 kPa change from about 45 seconds to about 60 seconds, and a −2 kPa change from about 60 seconds to about 90 seconds, was applied to the continually adjusted model. As can be seen in the chart of FIG. 3, the simulated behavior 302 and model prediction 304 have a closer alignment, even in the face of the added disturbance.

Figure 4:
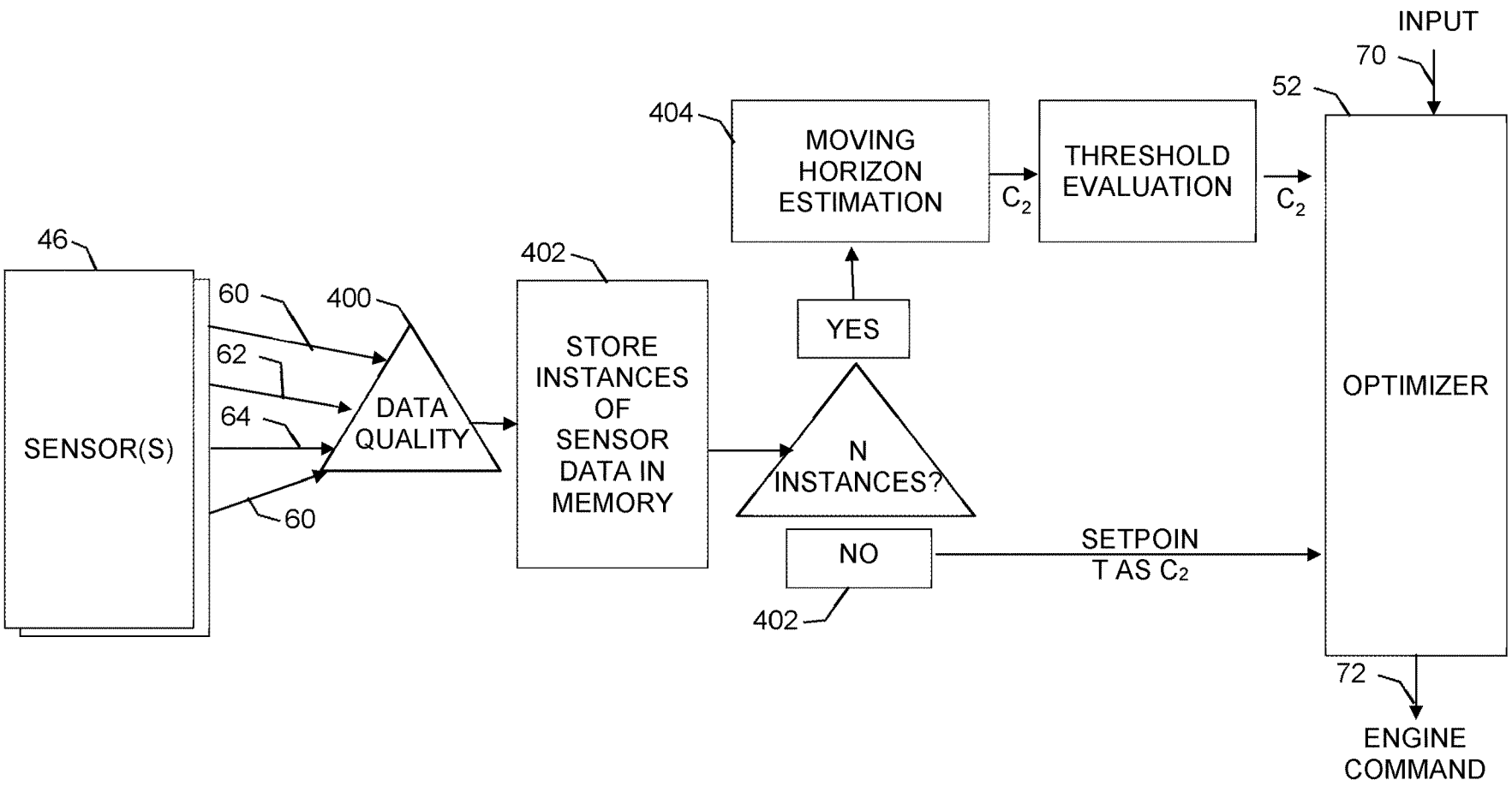
FIG. 4 is a block diagram of an exemplary moving horizon estimator for the engine controller of FIG. 1.

FIG. 4 depicts a functional block diagram illustrating an exemplary configuration for performing a moving horizon estimation in a manner similar to the techniques discussed above. In particular, the diagram of FIG. 4 illustrates an exemplary embodiment in which sensor data from the one or more sensors 46 may be used by the engine controller 44 to adjust a boundary condition for the operational model executed by the optimizer 52. In this embodiment, the sensor data includes a first signal 60 indicative of the pressure at the inlet of the DPF 38, a second signal 62 indicative of an ambient pressure of the atmosphere 30, a third signal 64 indicative of a mass flow rate of the turbine 32, and at least one fourth signal 66 indicative of at least one temperature in the exhaust treatment system 16.

At block 400, the signals 60-66 may be evaluated, e.g., for data quality. For example, the signals 60-66 may be evaluated as to whether an indicated value is within a predetermined range, whether a variance relative to a previous instance of time is below a predetermined threshold, whether the signals 60-66 are indicative of a value, or any other suitable criteria. At block 402, at each instance of time, values indicative of the operating conditions, based on the respective signals, are stored in the memory 50. In some embodiments, in response to one of the signals 60-66 failing the evaluation for data quality, a value indicative of an operating condition based on that signal may not be stored in the memory. In some embodiments, the value may be replaced, e.g., by a value from another signal from another sensor, by a value from a previous instance of time, and/or by a modeled value. or the like.

In some embodiments, when less than a full set "N" of sensor values has been received in the memory, e.g., less than an amount needed for a moving horizon estimation of horizon size "N", the engine controller 44 may be configured, at block 402, to provide a "$c_2$" parameter with a predetermined setpoint value as a boundary condition for a model of the pressure at the inlet of the DPF 38 to the optimizer 52.

For instances of time in which at least "N" sensor values for each of the signals 60-64 have been stored in the memory 50, the engine controller 44 may be configured, at block 404, to perform a moving horizon estimation using the "N" most-recent of the values for each signal, e.g., using equations 1-7 above, or the like, in order to determine a "$c_2$" parameter at a next instance in time. In some embodiments, a total of N sensor values for each of the signals 60-64 is stored in the memory 50, e.g., such that as further sensor values are stored at successive instances of time, oldest sensor values for the signals 60-64 are removed and/or overwritten from the memory 50.

In some embodiments, the memory 50 may store a predetermined minimum value and a predetermined maximum value for the "$c_2$" parameter. For example, the predetermined minimum and maximum values may be determined in an off-line manner, and may correspond to an operable range for the DPF 38. In response to the determined "$c_2$" parameter being outside of the operable range established by the minimum and maximum values, the engine controller 44, at block 406, may perform a threshold evaluation to raise the determined "$c_2$" parameter to the minimum value or lower the determined "$c_2$" parameter to the maximum, respectively. In some embodiments, the engine controller 44 may use performance of this aforementioned threshold operation to determine that the DPF 38 is in need of regeneration and/or replacement. In some embodiments, the engine controller 44 may transmit a notification, e.g., a signal light, system message, or the like, indicate of the foregoing. In some embodiments, the engine controller 44 may schedule and/or initiate a regeneration process for the DPF 38.

The determined "$c_2$" parameter may be provided to the optimizer 52 as a boundary condition to adjust the operational model of the machine 10. The optimizer 52, e.g., based on an input 70 (e.g., from an operator of the machine 10) and the adjusted operational model, generates and executes an engine command 72 to operate the machine 10.

Although some of the examples above pertained to determining estimates and/or parameters for pressure, and in particular for the pressure at the inlet of the DPF 38, it should be understood that in various embodiments, similar techniques may be applied to any operating condition of the machine 10 which may tend to vary over time during operation of the machine 10. For example, similar techniques may be applied to one or more operating condition such as turbocharger shaft speed, exhaust manifold pressure, exhaust manifold temperature, intake manifold pressure, mass flow rate, one or more gaseous concentrations, etc. Additionally, while some of the examples above related to estimation of one parameter, it should be understood that, in various embodiments, any suitable number of parameters for an operating condition or operating conditions may be estimated, e.g., in conjunction with one another, in parallel, in series, or in any suitable arrangement.

Further, while some terms or values were described as determined off-line, it should be understood that, in some embodiments, one or more of such terms or values may be determined in an on-line manner, or vice versa.

In some embodiments, the second signal 62 indicative of an ambient pressure of the atmosphere 30 may not be stored at each instance of time. For instances in which a value of the second signal 62 is not stored, a most-recent value may be substituted. In some embodiments, the moving horizon estimation is only performed if the pressure at the inlet of the DPF 38 indicated by the first signal 60 is above a predetermined minimum threshold pressure.

In some embodiments, one or more of weights "$W_1$" and "$W_2$" or the horizon size "N" may be adjusted, e.g., based on a variance in the pressure at the inlet of the DPF 38. In other words, various aspects of the moving horizon estimation may be adjusted dynamically in order to account for varying amounts of noise in the value of the operating condition.

INDUSTRIAL APPLICABILITY

An engine controller 44, such as those described in one or more of the embodiments above, that is configured to dynamically adjust one or more boundary conditions of an operational model of a machine, e.g., via a moving horizon estimation of one or more parameters of one or more operating conditions of the machine, may be used in conjunction with any appropriate machine, vehicle, or other device or system that includes an internal combustion engine having one or more components with a behavior that may vary over time during operation, and in particular that may vary not due to a fault or degradation, but rather to circumstances that accumulate or change over time.

An engine controller 44 utilizing a moving horizon estimation boundary condition may be applied, for example, to internal combustion engines that have components whose behavior may change due to, for example, accumulation of ash, soot, ice, moisture, or the like. Such an engine controller 44 may be used in conjunction with an optimizer configured to generate engine commands that optimize operation of a machine. Such an engine controller 44 may be used in conjunction with various types of engines and fuel systems, such as engines with common rail diesel fuel injection, unit diesel fuel injection, dual fuel injection (e.g., diesel and gaseous fuel), or gaseous fuel injection. The engine controller 44 may also be applied in a variety of machines or vehicles, including machines applicable for earthmoving, paving, power generation, mining, marine applications, transportation, or others.

In machines including an internal combustion engine including a turbocharger, it may be desirable to maintain a feasible flow through the engine that balances a mass flow rate in a compressor at an engine inlet with a mass flow rate of a turbine in an exhaust system. It may be beneficial to account for a variance in a behavior of an operating condition of the machine over the course of operation. It may be beneficial to dynamically adjust an operational model of the machine, and/or a boundary condition thereof, using a moving horizon estimation that takes multiple instances of sensor data to make predictions.

Figure 5:
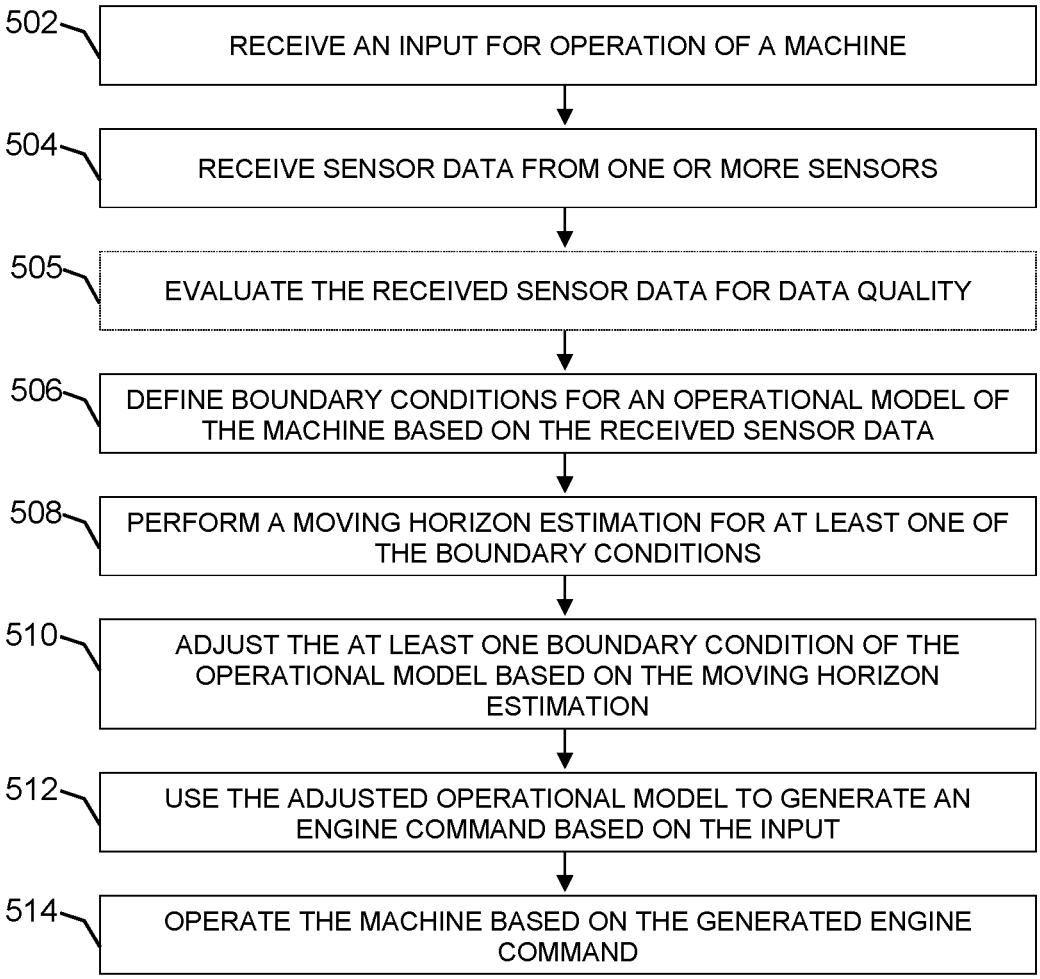
FIG. 5 is a flowchart of a machine control method that includes a moving horizon estimation operation, according to aspects of the present disclosure.

FIG. 5 is a flowchart illustrating an exemplary method 500 for operating a machine 10 according to one or more embodiments of this disclosure. While certain operations are described as being performed by certain components, it should be understood that such operations may be performed by different components and/or different combinations of components. Moreover, some operations may be executed at the instruction of and/or by the processor 48. Further, it should be understood that one or more of the operations below may be performed concurrently and/or in an order different than the order presented below. Additionally, in various embodiments, one or more of the following operations may be omitted, and/or additional operations may be added.

At block 502, the control system 18 may receive an input 70. The input 70 may include, for example, input from an operation of the machine 10, e.g., a signal from a pedal, a gear selection, an input from a button, joystick, toggle, or the like, and may be associated with one or more of a desired speed for the machine 10, a desired torque for the output member 26, an operation of an implement of the machine 10, e.g., a mover, a shovel, a drill, a lift, etc., an activation or operation of a component, e.g., an air conditioning system, a regeneration system, or the like. The input 70 may be associated with an automatic command or instruction, e.g., in response to a predetermined instruction or to a signal or instruction from another machine, device, or system.

At block 504, the engine controller 44 may receive sensor data from the one or more sensors 46.

At block 505, the engine controller 44 may evaluate the received sensor data for data quality, e.g., as discussed above with regard to block 400 of FIG. 4.

At block 506, the engine controller 44 may define boundary conditions for an operational model of the machine 10 based on the received sensor data.

At block 508, the engine controller 44 may perform a moving horizon estimation for at least one of the boundary conditions.

At block 510, the engine controller 44 may adjust at least one boundary condition of the operational model based on the moving horizon estimation.

At block 512, the optimizer 52 may use the adjusted operational model to generate an engine command based on the input 70.

At block 514, the engine controller 44 may operate the machine 10 based on the generated engine command.

Figure 6:
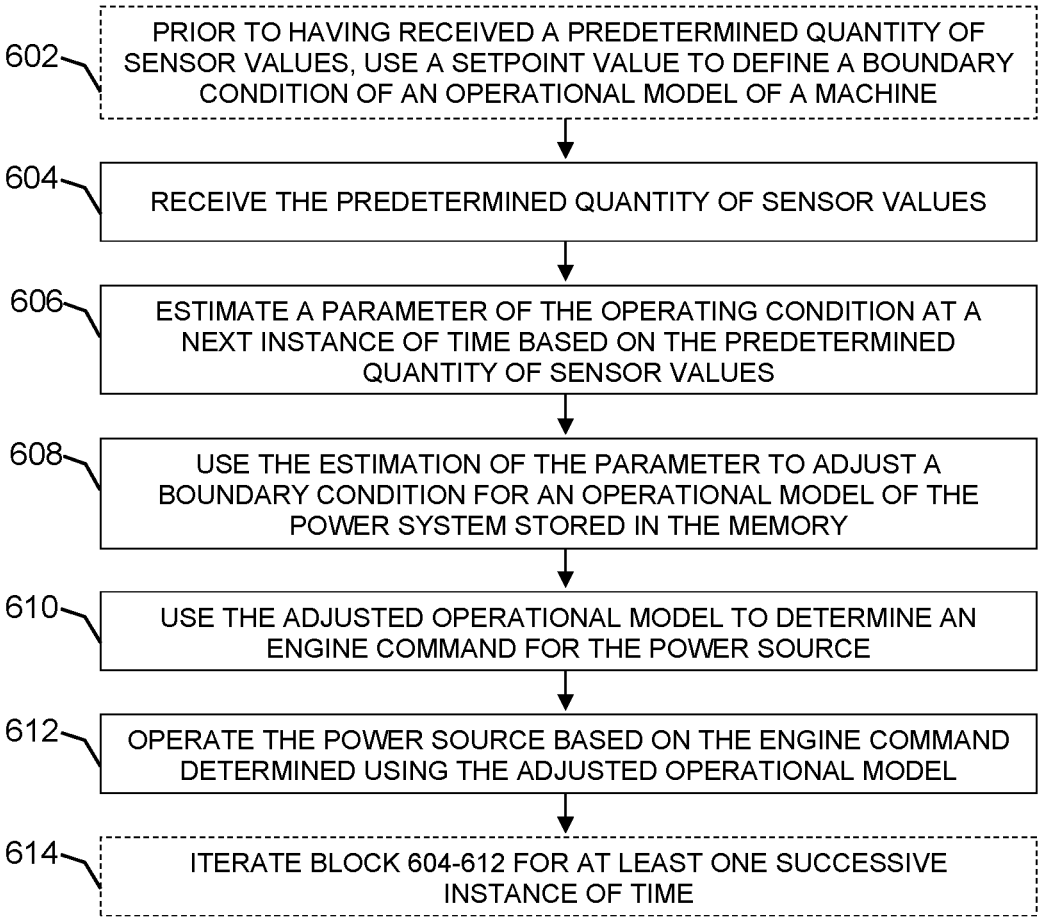
FIG. 6 is a flowchart for the moving horizon estimation operation of FIG. 5.

FIG. 6 is a flowchart illustrating an exemplary method 600 of performing a moving horizon estimation of an operating condition, e.g., step 508 in FIG. 5, according to one or more embodiments of this disclosure.

Optionally, at block 602, prior to having received a predetermined quantity of sensor values, the engine controller 44 may use a setpoint value to define a boundary condition of an operational model of the machine 10.

At block 604, the engine controller may receive the predetermined quantity of sensor values. The sensor values may be received, for example, from the one or more sensors 46 and/or from the memory 50. Each sensor value may be indicative of an operating condition of the machine, e.g., a power source 12 of the machine 10 such as a diesel engine, at a successive instance in time. In some embodiments, the predetermined quantity of sensor values is a most-recent quantity of successive values. In some embodiments, the operating condition is absolute pressure of an inlet of the DPF 38. In some embodiments, the at least one sensor includes a diesel particulate filter inlet absolute pressure sensor, and the sensor values are pressure values indicative of the pressure at the inlet of the DPF.

At block 606, the engine controller 44 may estimate a parameter of the operating condition at a next instance of time based on the predetermined quantity of sensor values. In some embodiments, the parameter of the operating condition is an on-line parameter. In some embodiments, the operating condition of the power source 12 is parameterized by the on-line parameter and a predetermined off-line parameter. In some embodiments, estimating the parameter includes applying a cost minimization function across the predetermined quantity of sensor values.

At block 608, the engine controller 44 may use the estimation of the parameter to adjust a boundary condition for an operational model of the power source 12 stored in the memory 50. In some embodiments, the boundary condition is a model of the absolute pressure of the inlet of the diesel particulate filter.

At block 610, the engine controller 44 may use the adjusted operational model to determine an engine command for the power source 12. In some embodiments, determining the engine command includes using the estimation of the parameter to predict a value for the operating condition at the next instance of time and in an operational state of the power source 12 that is different than an operational state of the power source 12 at the instances of time at which the sensor values were sensed. In some embodiments, the engine command is determined so as to optimize a balance between a first mass flow rate at an intake of the engine and a second mass flow rate through a turbine of a turbocharger of the power source 12.

At block 612, the engine controller 44 may operate the power source 12 based on the engine command determined using the adjusted operational model.

Optionally, at block 614 blocks 604-612 may be iterated for at least one successive instance of time.

One or more embodiments of this disclosure may promote a feasible flow through a power system of a machine. One or more embodiments of this disclosure may improve and/or stabilize an optimization of the operation of a machine. One or more embodiments of this disclosure may improve an alignment between the behavior of a machine and an operational model of the behavior of the machine. One or more embodiments of this disclosure may account for a behavior of one or more components of a machine that may vary over the course of operation of the machine. One or more embodiments of this disclosure may reduce a noisiness of an operating condition used as an input by an engine controller of a machine.

It should be understood that while some of the embodiments above include performing a moving horizon estimation for pressure at the inlet of the DPF, moving horizon estimation may be used for any suitable operating condition or combination of operating conditions.

It will be apparent to those skilled in the art that various modifications and variations can be made to the disclosed method and system without departing from the scope of the disclosure. Other embodiments of the method and system will be apparent to those skilled in the art from consideration of the specification and practice of the apparatus and system disclosed herein. It is intended that the specification and examples be considered as exemplary only, with a true scope of the disclosure being indicated by the following claims and their equivalents.

What is claimed is:

1. A computer-implemented method for controlling a diesel engine, comprising:

receiving a predetermined quantity of sensor values from a memory operatively connected to a sensor, each of the sensor values indicative of an operating condition of the diesel engine sensed by the sensor at a successive instance in time;

estimating a parameter of the operating condition of the diesel engine at a next instance of time based on the predetermined quantity of sensor values;

using the estimation of the parameter to adjust a boundary condition for an operational model of the diesel engine stored in the memory;

using the adjusted operational model to determine an engine command for the diesel engine that optimizes operation of the diesel engine; and operating the diesel engine based on the engine command determined using the adjusted operational model.

2. The method of claim 1, wherein:

the operating condition is absolute pressure of an inlet of a diesel particulate filter of the diesel engine;

the sensor is a diesel particulate filter inlet absolute pressure sensor; and the sensor values of the operating condition are pressure values.

3. The method of claim 2, wherein the boundary condition is a model of the absolute pressure of the inlet of the diesel particulate filter.

4. The method of claim 1, wherein:

the predetermined quantity of sensor values is a most-recent quantity of successive values; and the method is iterated for at least one successive instance of time.

5. The method of claim 1, wherein:

the parameter of the operating condition is an on-line parameter; and the operating condition of the diesel engine is parameterized by the on-line parameter and a predetermined off-line parameter.

6. The method of claim 1, wherein estimating the parameter includes applying a cost minimization function across the predetermined quantity of sensor values.

7. The method of claim 1, further comprising:

prior to receiving the predetermined quantity of sensor values, using a setpoint as the boundary condition for the operational model.

8. The method of claim 1, wherein:

determining the engine command includes using the estimation of the parameter to predict a value for the operating condition at the next instance of time and in an operational state of the diesel engine that is different than an operational state of the diesel engine at the instances of time at which the sensor values were sensed; and the engine command is determined so as to optimize a balance between a first mass flow rate at an intake of the engine and a second mass flow rate through a turbine of a turbocharger of the engine.

9. The method of claim 1, wherein the operating condition includes one or more of pressure at an inlet of a diesel particulate filter of the diesel engine, a shaft speed of a turbocharger of the diesel engine, a pressure of and exhaust manifold of the diesel engine, a temperature of the exhaust manifold, a pressure of an intake manifold of the diesel engine, a mass flow rate at one or more of the intake or the exhaust manifold, or one or more gaseous concentrations for flow associated with the diesel engine.

10. An engine control system for an engine, comprising:

a pressure sensor configured to sense an absolute pressure of an inlet of a diesel particulate filter of the engine; and an engine controller operatively connected to the pressure sensor, and including:

a memory storing:

an operational model of the engine including a boundary condition associated with the absolute pressure of the inlet of the diesel particulate filter, the boundary condition initialized with a setpoint; and instructions for controlling the engine; and a processor operatively connected to the memory, and configured to execute the instructions to perform operations including:

at each instance in time, receiving a pressure value from the pressure sensor and storing the received pressure sensor value in the memory;

in response to receiving and storing the pressure sensor value, determining whether a predetermined quantity of pressure sensor values are stored in the memory;

in response to determining that the predetermined quantity of pressure sensor values are stored in the memory:

estimating a parameter of the absolute pressure of the inlet of the diesel particulate filter at a next instance of time based on a most-recent predetermined quantity of the pressure sensor values; and using the estimation of the parameter to adjust a boundary condition of the operational model, the boundary condition associated with the absolute pressure of the inlet of the diesel particulate filter;

using the operational model to determine an engine command for the engine; and operating the engine based on the engine command determined using the adjusted operational model.

11. The engine control system of claim 10, wherein:

the parameter of the absolute pressure of the inlet of the diesel particulate filter is an on-line parameter; and the absolute pressure of the inlet of the diesel particulate filter is parameterized by the on-line parameter and a predetermined off-line parameter.

12. The engine control system of claim 10, wherein estimating the parameter includes applying a cost minimization function across the predetermined quantity of sensor values.

13. The engine control system of claim 10, wherein determining the engine command includes using the estimation of the parameter to predict a value for the absolute pressure of the inlet of the diesel particulate filter at the next instance of time and in an operational state of the engine that is different than an operational state of the engine at the instances of time at which the pressure sensor values were received.

14. The engine control system of claim 10, wherein the boundary condition is a model of the absolute pressure of the inlet of the diesel particulate filter.

15. The engine control system of claim 10, wherein the engine command is determined so as to optimize a balance between a first mass flow rate at an intake of the engine and a second mass flow rate through a turbine of a turbocharger of the engine.

16. An engine system for a vehicle, comprising:

a diesel engine;

a turbocharger including:

a compressor operatively connected to an intake of the diesel engine; and a turbine operatively connected to an exhaust of the diesel engine and to the compressor;

a pressure sensor configured to sense an absolute pressure at an inlet of the turbine; and an engine controller including:

a memory storing an operational model of the engine and instructions for operating the engine; and a processor operatively connected to the memory, and configured to execute the instructions to perform operations that include:

receiving, from the pressure sensor, a predetermined quantity of pressure sensor values indicative of the absolute pressure at the inlet of the turbine at successive instances in time;

estimating a parameter of the absolute pressure at an inlet of the turbine at a next instance of time based on the predetermined quantity of pressure sensor values;

using the estimation of the parameter to adjust a boundary condition for the operational model of the engine stored in the memory;

using the adjusted operational model to determine an engine command for the diesel engine; and operating the diesel engine based on the engine command determined using the adjusted operational model.

17. The engine system of claim 16, wherein:

the predetermined quantity of pressure sensor values is a most-recent quantity of successive values; and the operations are iterated for at least one successive instance of time.

18. The engine system of claim 16, wherein:

the parameter of the absolute pressure at an inlet of the turbine is an on-line parameter; and the absolute pressure at an inlet of the turbine is parameterized by the on-line parameter and a predetermined off-line parameter.

19. The engine system of claim 16, wherein estimating the parameter includes applying a cost minimization function across the predetermined quantity of pressure sensor values.

20. The engine system of claim 16, wherein the operations further include, prior to receiving the predetermined quantity of sensor values, using a setpoint as the boundary condition for the operational model.

* * * * *